US009376806B2

(12) United States Patent
Meyer

(10) Patent No.: US 9,376,806 B2
(45) Date of Patent: Jun. 28, 2016

(54) PORTABLE DYNAMIC LOAD AISLE PROTECTION SYSTEM

(71) Applicant: Gary Meyer, Golden, CO (US)

(72) Inventor: Gary Meyer, Golden, CO (US)

( * ) Notice: Subject to any disclaimer, the term of this patent is extended or adjusted under 35 U.S.C. 154(b) by 112 days.

(21) Appl. No.: 14/209,960

(22) Filed: Mar. 13, 2014

(65) Prior Publication Data

US 2014/0272241 A1 Sep. 18, 2014

Related U.S. Application Data

(60) Provisional application No. 61/782,144, filed on Mar. 14, 2013.

(51) Int. Cl.
*E04B 1/92* (2006.01)
*E04F 15/02* (2006.01)

(52) U.S. Cl.
CPC ..... *E04B 1/92* (2013.01); *E04F 15/02038* (2013.01); *E04F 2201/096* (2013.01); *Y10T 29/49826* (2015.01); *Y10T 428/16* (2015.01); *Y10T 428/24008* (2015.01)

(58) Field of Classification Search
CPC ..... E01C 2201/12; E04F 15/02038
USPC ..... 428/44; 52/578, 605
See application file for complete search history.

(56) References Cited

U.S. PATENT DOCUMENTS 3,802,144 A * 4/1974 Spica ..... E01C 11/225 404/36

* cited by examiner

*Primary Examiner* — Brent O'Hern
(74) *Attorney, Agent, or Firm* — Scott L. Terrell, P.C.; Scott L. Terrell

(57) ABSTRACT

A portable aisle protection system is provided. The system includes interlocking rectangular plate members capable of interconnecting in an aisle forming relationship. Each of the plate members has a smooth non-compressible top rolling surface, bottom and four sides. The four sides define peripheral edges. Three of the peripheral edges have interlocking formations. Non-compressible ramp rails have an inclined leading portion and a trailing edge. The inclined portion establishes an upward inclined plane, and the trailing edge includes interlocking formations adapted for interfitting butting engagement of the trailing edge with the respective peripheral edges of the plate members so that the ramp rails are capable of providing ingress and egress to the load protecting aisle formed by the plate members.

9 Claims, 5 Drawing Sheets

PORTABLE DYNAMIC LOAD AISLE PROTECTION SYSTEM

Pursuant to 35 U.S.C. 119(e), applicant claims the benefit of U.S. Ser. No. 61/782,144, filed, pursuant to 35 U.S.C. 111(b) on Mar. 14, 2013.

STATEMENT OF FEDERALLY SPONSORED RESEARCH

Not Applicable.

BACKGROUND OF THE INVENTION

1. Field of the Invention

The present invention relates to dynamic load floor protection. In particular, it relates to an improved system and method for protecting raised access floor panels from castor wheel assembly damage when moving computer server racks, or frames, in aisles established between server racks supported on raised floors in a data center.

2. Description of the Related Art

Raised floors are used in data centers to create a space between a sub-floor of the building and the normal working environment of the computer room. The space between the sub-floor and the raised floor panels creates an under-floor cool-air circulating plenum for thermal management of the data processing servers installed in banks of rack systems on top of the raised floor. The floor panels, themselves, are either solid or perforated. The solid panels are typically used for supporting heavy static or rolling loads. Dynamic rolling loads are mostly encountered when moving computer server frames about the raised floor in a data processing center.

Rolling server frames or racks are typically supported on a castor wheel assemblies positioned on the lower corners thereof. Because the dynamic loads of rolling frames are higher than the static loads of stationary frames, floor protection is needed at delivery time. It is also important to consider the caster point loads. Some floors cannot withstand the force which is exerted by the casters of with heavier systems. For example, caster point loads on some servers can he as high as 907 kg (2,000 lb). A problem arises during deliver and installation of server racks or frame as this s extreme load can easily penetrate, or otherwise cause significant damage, the surface of the floor panels. In addition, with raised floors, the floor panels themselves are most commonly constructed with perforations, or air-grate, which allow for a cooling air flow directed through the floor panels themselves. This air-grate surface of the floor panels inhibits free rolling of the caster wheel assemblies during delivery or installation.

Thus, it is necessary to protect the raised floor panel from such damage when moving servers, or relocating processors, in the computer room. With the prior art, however, it has been found that 10 mm plywood sheeting sometimes provides adequate protection, and this plywood sheeting has gained wide acceptance in the industry. Moreover, in delivery and installation of some of the heavier high-end servers, the industry has also recommended that one uses a tempered Masonite or plyron; instead of plywood which might be too soft for the heavier servers. Plywood also tends to break down and entrain contaminants which spread throughout the data center. In addition, break down often occurs, with any of the foregoing examples, at the seams, formed between adjacent plywood sheets, where the castor wheel assemblies cause impact point deflection and damage to the edges of the protective sheets. Finally, modern data centers are designed to maximize the amount of processing capability per square foot of data center floor space. As such, floor space is at a premium, and the architectural design of the data center thus requires a minimum aisle width, so long as the aisle width is in compliance with lawful rules and regulations, such as the Americans With Disabilities Act ("ADA"). Therefore, when using either plywood or masonite, as an aisle protection overlay, the sheets must typically be cut to narrow widths, desirably less than 101 centimeters, which further servers to decreases the integrity and load bearing capacity of these materials.

Thus, what is needed is portable containment system for containing dynamic rolling loads on a raised floor. The present invention satisfies these needs.

BRIEF SUMMARY OF THE INVENTION

It is therefore an object of the present invention to provide a portable containment system for containing dynamic rolling loads.

It is yet another object of the present invention to provide a portable containment system for containing dynamic rolling loads exerted by the castor wheel assemblies of computer server racks when moving in the aisles between server racks supported on a raised floor, in a data center.

To overcome the problems of the prior art, and in accordance with the purpose of the present invention, as embodied and broadly described herein, briefly, a portable aisle protection system is provided. The system includes a plurality of interlocking rectangular plate members capable of interconnecting in an aisle forming relationship. Each of the plate members has a non-compressible smooth top rolling surface, bottom and four sides. The four sides define peripheral edges. Three of the peripheral edges have interlocking formations. Non-compressible ramp rails have an inclined step leading portion and an interlocking trailing edge. The inclined step portion is capable of providing an inclined plane, and the trailing edge includes interlocking formations adapted for interlining butting engagement of the trailing edge with the respective peripheral edges of the plate members so that the ramp rails are capable of providing ingress and egress to the load protecting aisle formed by the plate members.

Additional advantages of the present invention will be set forth in part in the description that follows, and, in part, will be obvious from that description or can be learned from practice or testing of the present invention. The advantages of the preferred embodiments of the present invention can now be realized and obtained by the invention as more particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the present invention and, taken together with the description, explain the principles of the invention.

DETAILED DESCRIPTION OF THE DRAWINGS

Figure 1:
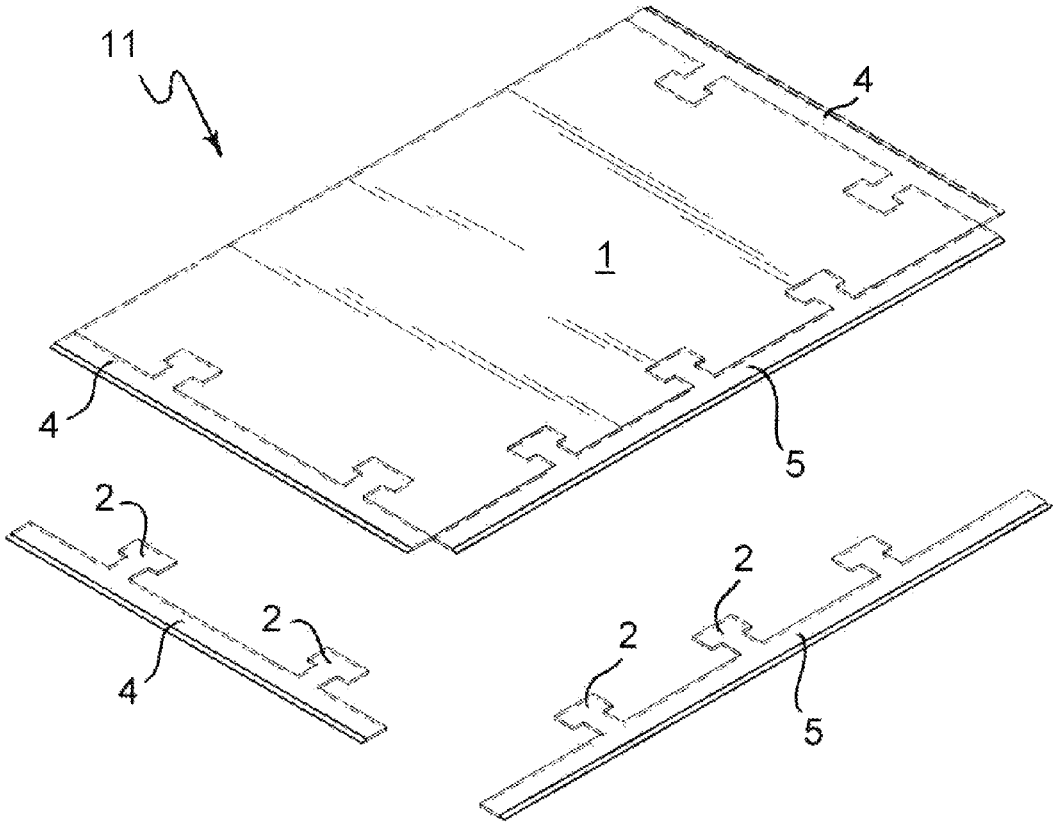
FIG. 1 is an isometric top view of the main lead section showing an embodiment of the plate member element with interfitting side and end ramp rail members.

Unless specifically defined otherwise, all scientific and technical terms, used herein, have the same ordinary meaning as would be commonly understood by one of ordinary skill in the art to which this invention belongs. In practice, the present invention contains dynamic rolling loads exerted when moving computer server racks on the aisles created between server racks in a data center. In a raised access floor construction, the raised floor panels are suspended on matrix of pedestal support legs. The pedestal support legs are connected with stringers. Such raised floor systems are well known in the art. The raised floor panels themselves are typically 61×61 centimeters, and either generate a solid or air-grate steel working surface. The minimum aisle width between server racks is regulated by the American with Disabilities Act ("ADA"). The current minimum ADA aisle width is 91 centimeters so that the preferred width dimension of the present invention is a functional dimension to generally fit within this requirement and not merely a design feature.

Although any methods and materials similar or equivalent to those described herein, can be used in the practice or testing of the present invention, the preferred methods and materials are now described. Reference will now be made in detail, to the presently preferred embodiments of the invention, including the examples of which are illustrated in the accompanying drawings. In the drawings, like numerals will be used in order to represent like features of the present invention.

The present invention provides a portable aisle protections system for containing a dynamic rolling load in a data center. A plurality of non-compressible interlocking rectangular plate members 1 are capable of interconnecting adjacent to one another in a predetermined aisle forming relationship between server racks. Each of the plate members 1 has a smooth top surface being capable of providing a rolling surface, a bottom surface and four sides. The four sides collectively define at least three peripheral edge portions. The peripheral edge portions have a plurality of interlocking formations. The interlocking formations preferably include spaced locking fingers 2 interspersed with locking apertures 3. The locking fingers 2 and locking apertures 3 are of any design well known in the art.

In a presently preferred embodiment, the plate members 1 are designed in a dimensional configuration which is critical to the stated function of supporting a dynamic rolling server load, over an air-grated floor panel, along an ADA minimum aisle width, in a data center. Consistent therewith, the plate member 1 has been empirically determined as a rectangle construction being approximately 91 centimeters wide×141 centimeters long. These dimensions are critical so that the present invention functions to prevent seamed deflection, and dimpling to the raised floor panels caused by the castor wheel assemblies when moving server racks in the aisles formed according to the ADA minimum requirements. These functional design elements are illustrated in the description of the following example.

EXAMPLE

Figure 4:
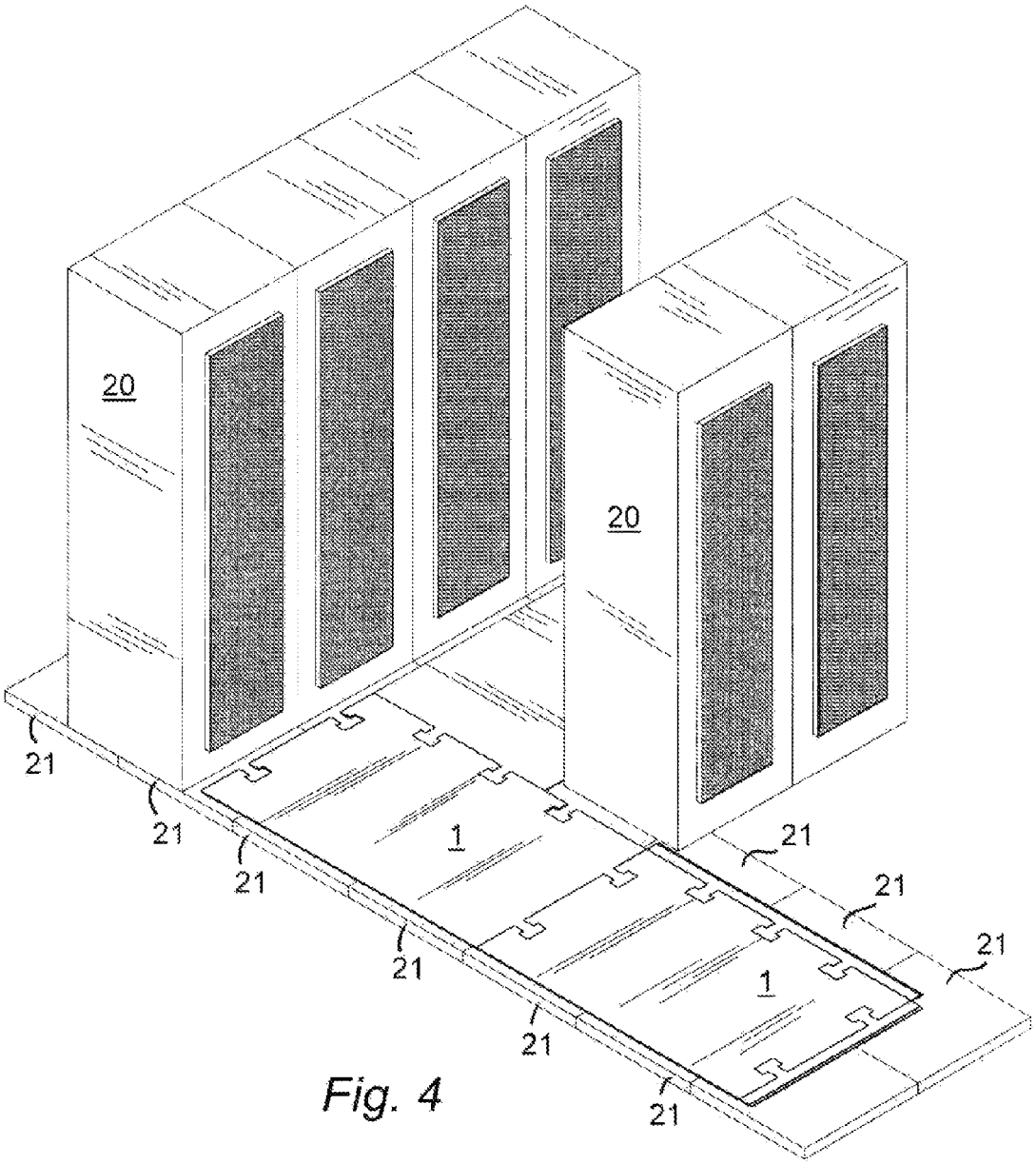
FIG. 4 is perspective view of the present invention positioned to overlay the floor panels in an aisle forming relationship between rows of computer servers

For example, referring to FIG. 4, in a typical 61 cm×61 cm raised floor panel 21 matrix construction, the rectangular plate 1 spans the existing seams between adjacent raised floor panels 21 to prevent deflection. Also, because the current ADA minimum aisle width, between server racks, is about 91 centimeters, the side ramp rails 5 and plate 1 members cannot exceed that distance, when assembled. Thus, consistent with the foregoing constraints, the present invention, when assembled, is functionally designed to form a dynamic load protective 91 cm aisle with a long dimension of the floor plate members 1 engineered to span the 61×61 centimeter seams existing between the adjacent floor panels 21. The system is also functionally designed for fitment within the minimum mandatory ADA aisle width existing between rows of server racks, or frames. Moreover, the plate members 1 are desirably manufactured of 0.635 centimeter thick 5052 grade Aluminum plate so that the aisle formed thereby is non-deformable and being capable of supporting rolling loads in the nature of 725-907 kilograms. Such rolling loads have been empirically determined as the rolling point loads of the castor wheel assemblies when used to roll server racks weighing in excess of 544 Kg. Finally, the lengthwise dimension of the plates 1 allows for an approximately 297 centimeter long assembly when two of the plates members 1 are connected, end-to-end, which, again, obviates seamed deflection of the underlying 61×61 centimeter raised floor panels. Thus, the foregoing dimensions are empirically and functionally related to the intended purpose and use of the present invention.

Figure 3:
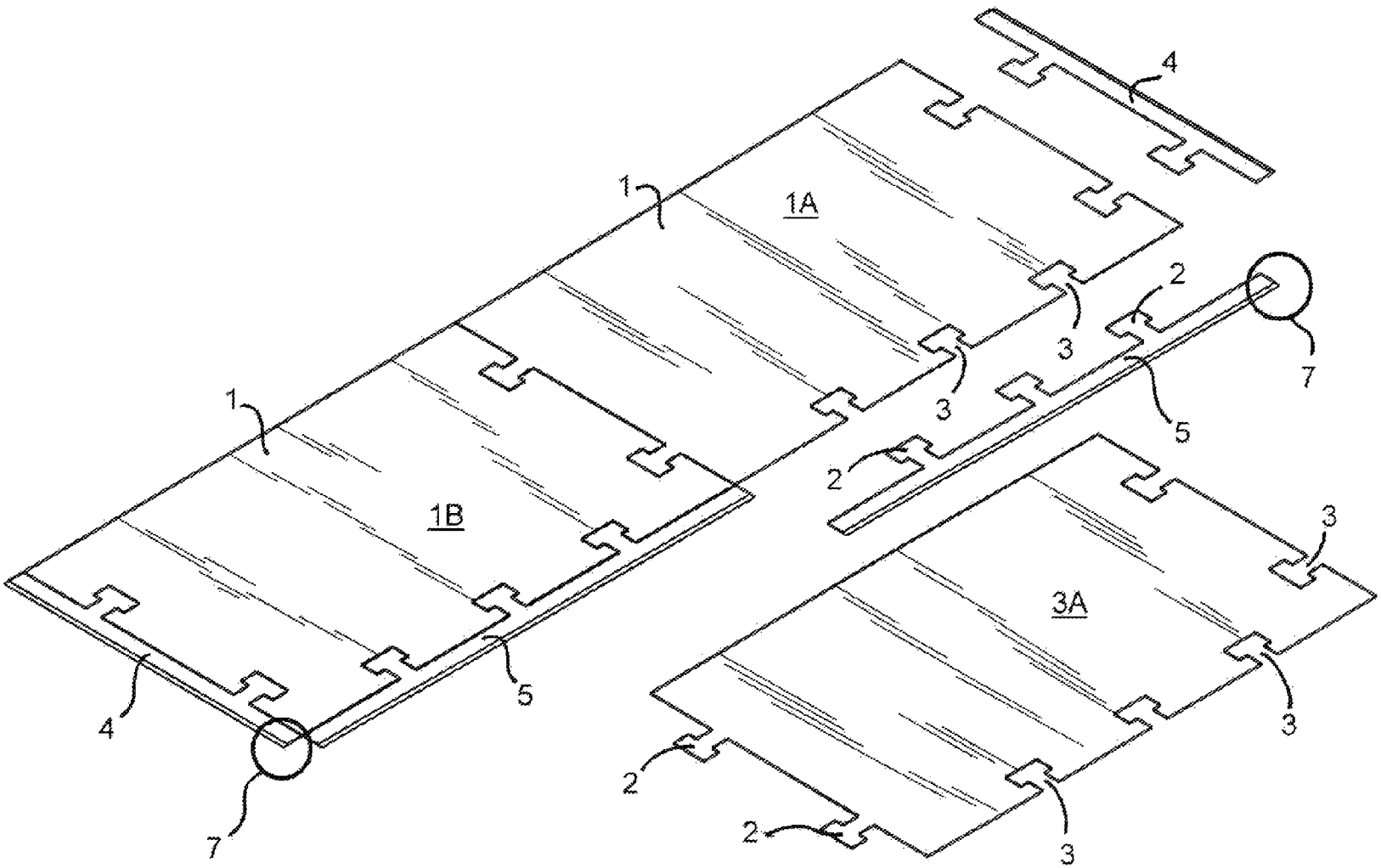
FIG. 3 is an isometric top view showing two of the preferred embodiments of the plate members. Here, the right hand plate member (1A) includes male interlocking formations being interconnected with the female interlocking formations of the left hand plate member (1B) which obviates the use of the plate connector, in FIG. 2, in forming a floor protecting aisle.
Figure 5:
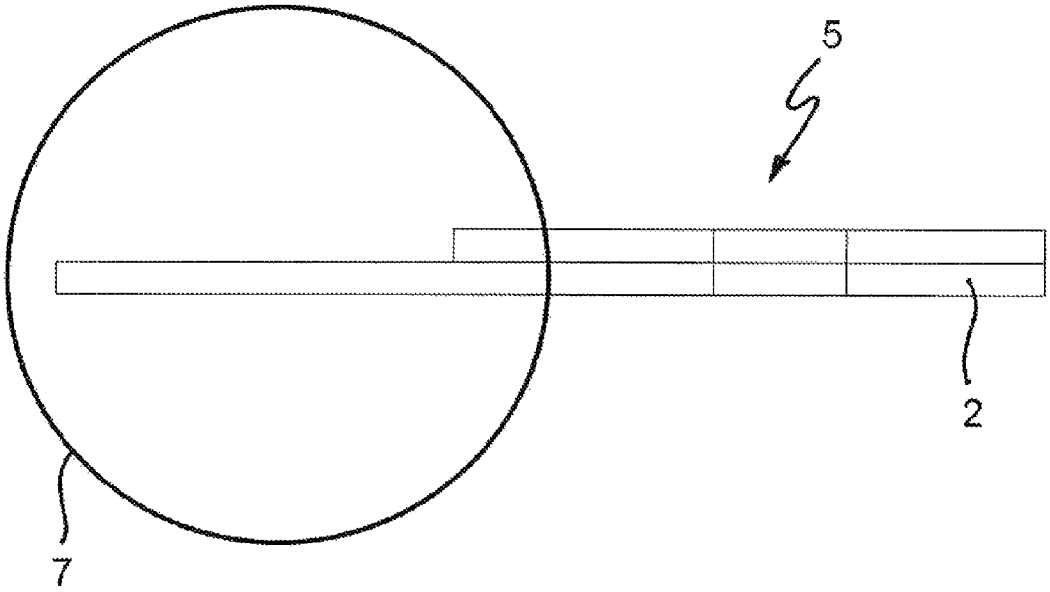
FIG. 5 is a side view of the preferred embodiment of the ramp rail being established through an overlapping built-up plate member assembled as a laminate construction.

Turning to the drawing FIGS. 1, and 3, in the preferred embodiment, the system includes at least two non-compressible end 4, or side 5 ramp rail members. The ramp rail members 4, 5 have an inclined leading portion 7 and a trailing edge 8. The inclined portion 7 is adapted so that the ramp 4, 5 is capable of lifting engagement with the castor wheel assemblies supporting the server frames, or racks, to lift the load upwardly and onto the aisle formed with the protective floor plate members 1. As show in FIG. 5, the incline portion 7 is desirably constructed as a built-up member in an overlapping stepped plate laminate construction using separate overlapping horizontal 0.318 cm thick sheets of aluminum. However, the inclined portion 7 may be constructed according to any formation known in the art including tapering the leading portion 7 in a ramped or chamfer steel machining.

The trailing edge of the ramp rails 4, 5 has an interlocking formations which are adapted for interfitting and interlocking butting engagement of the trailing edge with the respective interlocking formations 2, 3 of the plate members 1, so that the ramps 4, 5 are capable of assembly with the plate members 1 in order to permit the castor wheel assemblies, of the server racks, with an ingress and an egress approach to the plate 1 top surfaces. In this manner, one is capable of rolling the server racks onto the portable protective aisle formed with the present invention.

Referring now to FIG. 1, one embodiment of the plate member 1 main lead section 11 is shown where the interlocking formations are of a female design, using interlocking apertures 3 and a central locking finger 2. Here, the plate member 1 is adapted with opposing edge portions whereby the interlocking formations are symmetrically designed so that the plate member 1 is capable of interlining and interlocking butting engagement with like plate members 1 using the plate connector 12 shown in FIG. 2. It may be readily appreciated, by one of skill in the art, that with this embodiment the connector 12 and end 4 and side 5 ramp rail members are all configured with the same interlocking formations for universal fitment of the foregoing elements in a wide variety of aisle forming configurations, such as the configuration illustrated in FIG. 4.

Figure 2:
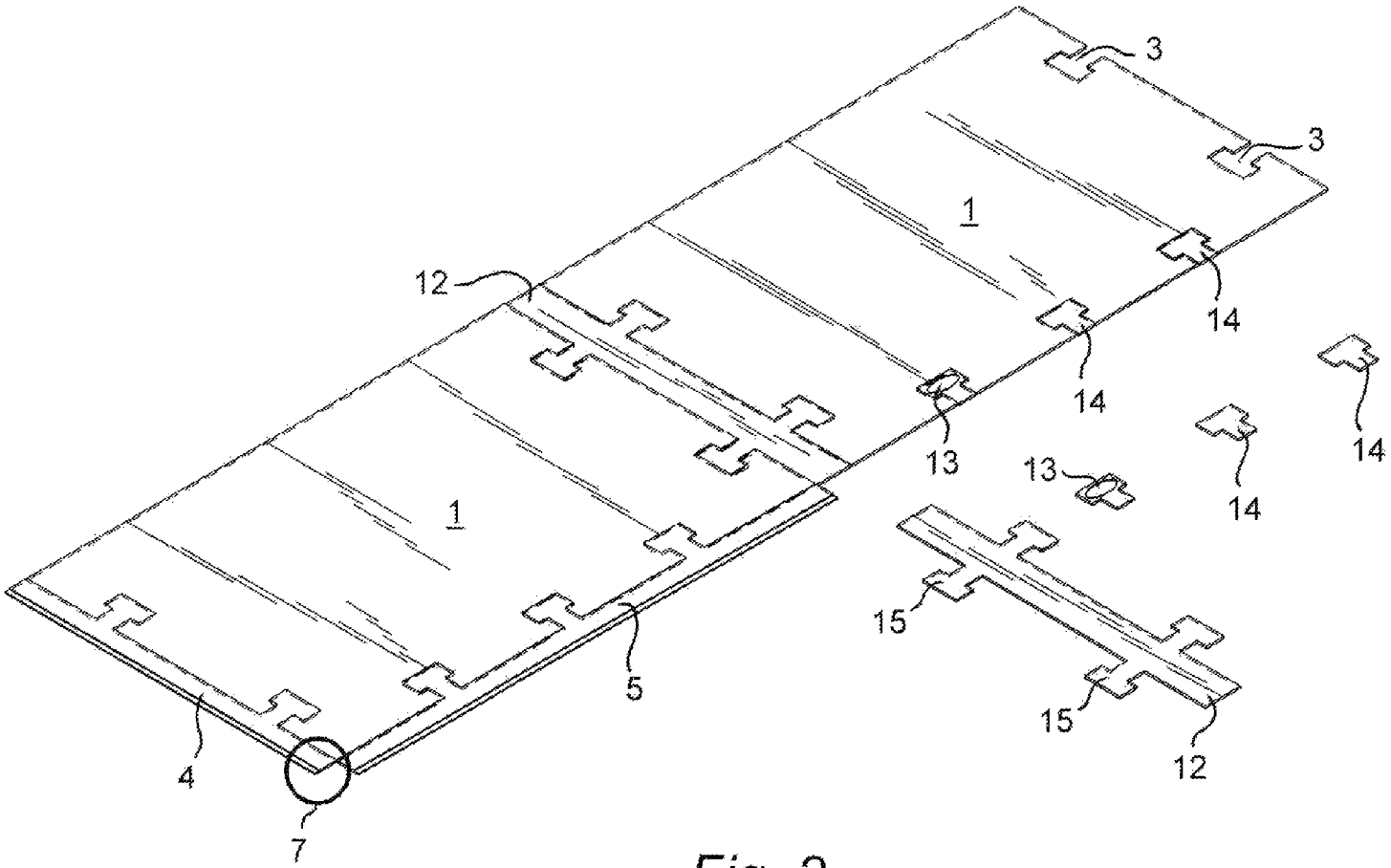
FIG. 2 is an isometric top view of the main lead section shown in FIG. 1, connected to a second plate using a double sided interlocking connector, together with illustrations of the solid and handle plate filler inserts for pressed fitment into the apertures of the plate member.

Turning now to FIG. 2, the plate connector 12 is also a non-compressible structure with a smooth rolling top surface. As above, the plate connectors 12 are desirably aluminum in manufacture, and have a smooth top surface, a bottom surface and four sides. The four sides collectively define double-sided peripheral edge portions. The connector edge portions have complimentary interlocking formations. The interlocking formations preferably include spaced locking lingers 15 with locking apertures adapted for interlining and interlocking butting engagement of the connector edges with the respective complimentary portions of the floor plate 1 peripheral edge formations 2, 3, so that the connectors 12 are capable of assembly together between the plate members 1 in an aisle forming relationship.

Shown in drawing FIG. 3 is a presently preferred embodiment of the assembly of the aisle forming plate members 1A, 1B. As shown in the drawing figure, the left most plate member 1B is designed with male and female interlocking formations being capable of interlocking with the female plate member 1A on the right side of the FIG. 3 illustration. Here, the plate members 1A, 1B are adapted with interfitting formations so that the plate members 1A, 1B are capable of interfitting and interlocking butting engagement with at least one of the respective opposing edge portions of a like plate without the use of the connectors 12, shown in FIG. 2.

Referring back to drawing FIG. 2, the plate member 1 may, but need not, include an aperture 13, in a filler plate 14, which is adapted as a handle for lifting the plate member 1, in use. With this embodiment, it is also desirable to further include, as an element of the system, the solid filler plates 14. The filler plate 14 is configured so that it is capable of pressed fitment within the aperture 3 so the filler plate 14 maintains a non-compressible planar rolling surface with the top of the plate member 1.

In use, the present invention provides a method for containing a dynamic rolling load in a data center. For example, the present invention provides a method for protecting raised floor air-grate panels 21 in a data center from damage caused by the castor wheel assemblies when moving computer servers, racks, or frames. Here, in a series of steps, which may, but need not, be preformed in sequence, the operator provides a plurality of the non-compressible interlocking rectangular protective plate members 1 and interconnects the plate members 1 adjacent to one another in the predetermined aisle formed between rows 20 of server racks, or frames. The ramp rails 4, 5 are connected to the plate members 1 in an assembly configured to provide for ingress and egress of the server racks, or frames, on an off of the load protecting aisle formed with the protective plate members 1. After the server racks, or frames, are redeployed to a predetermined location, the plate 1 and ramp rail 4, 5 elements are easily separated and loaded on a cart, or pallet, for portable reuse.

While the present invention has been described in connection with the illustrated embodiments, it will be appreciated and understood that modifications may he made without departing, from the true spirit and scope of the invention.

I claim:

1. A portable aisle protection system for containing a dynamic rolling load, comprising;

a. a plurality of solid interlocking rectangular protective plate members capable of interconnecting assembly adjacent to one another in an aisle forming relationship, each of said plate members having a non-compressible solid smooth top rolling surface, a solid bottom supporting surface and four side walls, wherein at least three of said side walls are configured to collectively define a plurality of interlocking tongue and groove edge formations; and b. a non-compressible ramp rail member, said ramp rail member having a leading portion and a trailing edge, said leading portion capable of providing an incline axis, said trailing edge including a plurality of interlocking formations, whereby said interlocking formations being capable of interfitting and interlocking butting engagement with said interlocking formations of said protective plate members so that said ramp rail member is capable of providing an inclined lifting ingress of the rolling load onto the plate member.

2. The portable aisle protection system according to claim 1, further comprising at least one non-compressible plate connector, said connector having a solid smooth top rolling surface, a solid bottom surface and four sides walls, wherein at least two opposite of said side walls collectively defining two connector interlocking edge portions, said connector interlocking edge portions being configured as a plurality of tongue and groove interlocking formations being adapted for interfitting and interlocking butting engagement of said connector interlocking edges with respective portions of said peripheral interlocking tongue and groove edge formations of said plate members so that said connectors are capable of connected and non-deformable assembly between two of said plate members in an server rack aisle forming relationship.

3. The portable aisle protection system according to claim 1, wherein said plate members further include at least one plate lifter aperture disposed adjacent to one of said side walls, said lifter aperture being configured for use as a handle, and said system further including a solid top filler plate member configured so that said filler plate is capable of pressed fitment into said lifter aperture and to establish a smooth contiguous planar surface with the top surface of the plate.

4. The portable aisle protection system according to claim 1, wherein said incline is a built-up member of overlapping plates.

5. A portable aisle protection system for containing a dynamic rolling load, comprising:

a. a plurality of interlocking rectangular protective plate members capable of interconnecting assembly adjacent to one another in an aisle forming relationship, each of said plate members having a non-compressible smooth rolling top surface, a bottom surface and four sides, the four sides collectively defining four peripheral edges, wherein three of said peripheral edges include a plurality of interlocking formations;

b. a non-compressible ramp rail member, said ramp rail member having a leading portion and a trailing edge, said leading portion capable of providing an incline axis, said trailing edge including a plurality of interlocking formations, whereby said interlocking formations being capable of interfitting and interlocking butting engagement with said interlocking formations of said protective plate members so that said ramp rail member is capable of providing an inclined lifting ingress of the rolling load onto the plate member; and (c) wherein said plate member is a 5052 rectangular Aluminum plate substantially 141 centimeters long×91.4 centimeters wide, and 0.635 centimeters thick.

6. The portable aisle protection system according to claim 5, further comprising at least one non-compressible plate connector, said connector having a smooth top rolling surface, a bottom surface and four sides, the four sides collectively defining two connector interlocking edge portions, said connector edge portions having a plurality of interlocking formations being adapted for interfitting and interlocking butting engagement of said connector edges with respective portions of said peripheral interlocking edge portions of said plate members so that said connectors are capable of connected and non-deformable assembly between two of said plate members in an server rack aisle forming relationship.

7. The portable aisle protection system according to claim 5, wherein said plate members further include at least one aperture disposed adjacent to one of said sides, said aperture adapted for use as a handle, and said system further including a filler plate member configured so that said filler plate is capable of pressed fitment into said lifter aperture and to establish a smooth contiguous planar surface with the top surface of the plate.

8. The portable aisle protection system according to claim 5, wherein said interlocking formations being spaced locking fingers and at least one locking aperture.

9. The portable aisle protection system according to claim 5, wherein said incline is a built-up member of overlapping plates.

* * * * *